US005358331A

United States Patent [19]

Cruse

[11] Patent Number: 5,358,331

[45] Date of Patent: Oct. 25, 1994

[54] BLENDING DEVICE FOR PARTICULATE MATERIAL, WITH HELICAL CONVEYER

[75] Inventor: John William Cruse, Robertsbridge, United Kingdom

[73] Assignees: John William Cruse, Robertsbridge; Pharmakopius Limited, Pharmakopius at:Goring-on-Thames, both of United Kingdom

[21] Appl. No.: 80,558

[22] Filed: Jun. 21, 1993

Related U.S. Application Data

[63] Continuation of Ser. No. 221,789, Jul. 20, 1988, abandoned.

[30] Foreign Application Priority Data

Feb. 27, 1986 [GB] United Kingdom ..... 8604811

[51] Int. Cl.[5] ..... B01F 15/02; B01F 7/08

[52] U.S. Cl. ..... 366/181; 366/319; 366/320; 366/323

[58] Field of Search ..... 366/8, 16, 20, 27, 35, 366/38, 50, 64, 79, 133, 134, 156, 158, 160, 177, 181, 186, 150, 194–196, 318–320, 323; 198/670, 676

[56] References Cited

U.S. PATENT DOCUMENTS

| | | | |
|---|---|---|---|
| 858,017 | 6/1907 | Pence | 366/35 |
| 1,763,121 | 6/1930 | Bailey | 198/670 X |
| 2,320,469 | 6/1943 | Rasmussen | 366/320 X |
| 2,538,891 | 1/1951 | Zimmerman et al. | 366/319 X |
| 2,617,351 | 11/1952 | Graham, Jr. et al. | 366/318 X |
| 2,953,360 | 9/1960 | Kline | 366/323 X |
| 3,136,308 | 6/1964 | Giovagnoli | 366/195 X |
| 3,198,142 | 8/1965 | Lothes | 366/79 X |
| 3,377,000 | 4/1968 | Mason, Jr. | 366/319 X |
| 3,645,505 | 2/1972 | McLeod, Jr. et al. | 366/177 X |
| 4,071,226 | 1/1978 | Miller | 366/35 X |
| 4,205,919 | 6/1980 | Attwell | 366/320 X |
| 4,441,231 | 4/1984 | Baccetti | 366/320 X |
| 4,483,625 | 11/1984 | Fisher | 366/196 X |

FOREIGN PATENT DOCUMENTS

| | | | |
|---|---|---|---|
| 135145 | 5/1947 | Australia | 366/156 |
| 150353 | 8/1985 | European Pat. Off. . | |
| 1917435 | 11/1969 | Fed. Rep. of Germany | 366/149 |
| 512843 | 10/1920 | France | 366/158 |
| 1062514 | 4/1954 | France . | |
| 1397988 | 3/1965 | France . | |
| 2264640 | 10/1975 | France . | |
| 504315 | 12/1954 | Italy | 366/318 |
| 81227 | 7/1956 | Sweden | 366/158 |
| 650645 | 2/1951 | United Kingdom | 366/320 |
| 2060421 | 5/1981 | United Kingdom . | |
| 2090761 | 7/1982 | United Kingdom . | |

*Primary Examiner*—Timothy F. Simone
*Assistant Examiner*—Charles Cooley
*Attorney, Agent, or Firm*—Michael J. Striker

[57] ABSTRACT

A device for continuously blending particulate materials has a central shaft, a plurality of metering elements which are each separately metering a respective particulate material, blending element for receiving and blending the metered quantities of particulate material and including a conveyor formed as an elongate member having a rotating axis coinciding with the axis of the shaft and disposed helically in turns about and concentric to the rotating axis, a drive for rotating the elongate member to trace out an envelope shape of the helically formed elongate member, and a casing accommodating the conveyor and having a discharge and a lower portion conforming to the envelope shape of the elongate member. The conveyor rotates in the casing to generate a conveying direction, and stirring members are provided on the conveyor and extend between some of its turns. The elongate member has a cross-section which is of arcuate form at least on a side facing the conveying direction to create an inefficient conveyor, and the stirring members are arranged on an outside portion of at least adjacent turns of the elongate member.

4 Claims, 2 Drawing Sheets

BLENDING DEVICE FOR PARTICULATE MATERIAL, WITH HELICAL CONVEYER

This is a continuation of application Ser. No. 221,789 filed Jul. 20, 1988 now abandoned.

TECHNICAL FIELD

This invent ion is concerned with a device for blending a mixture of particulate materials.

Many industries have a requirement for a blended mixture of particulate materials containing accurate proportions of the materials. The food, chemical, pharmaceutical, agricultural and horticultural industries at least have such requirements.

SUMMARY OF THE INVENTION

According to the present invention a device for continuously blending particulate materials includes a plurality of metering means, each to meter a particulate material, and blending means to receive and blend the metered quantities of particulate material delivered from the respective metering means, said blending means comprising a conveying means in the form of an elongate member disposed helically about a rotating axis of the conveying means, the cross-section of the elongate member being of arcuate form at least on the side thereof facing the conveying direction of the conveying means, the conveying means being located in a casing conforming to the envelope shape of the helically formed elongate member over a lower portion thereof.

Conveniently the pitch of the helically formed number is constant throughout its length and the elongate member is desirably of circular cross-section. Preferably stirring members are provided on the conveying means which extend between at least some adjacent turns of the helically formed member. Conveniently some of the stirring members are located on the outside of the respective helical turns (i.e. between the conveying means and its casing) and some on the inside of the respective helical turns (i.e. between those turns and the axis of rotation of the conveying means). The stirring members can, with advantage, be disposed parallel to the axis of the conveying means and an aligned series of stirring members extending from end to end of the conveying means can be provided by a single bar, rod or wire extending from the first turn to the last turn of the helically formed member. Conveniently stirring members extending the full length of the helically formed member alternate in being secured inside and outside the helical turns.

The metering means can conveniently each also comprise a respective conveying means formed from an elongate member of at least part-arcuate cross-section helically disposed and mounted for rotation about its helical axis.

The helically formed member of the conveying means of the blending device is designed to run at high speed in a casing containing particulate material to a depth of not much more than that required to cover the lower part of each turn of the elongate member. The conveying means in each metering conveying means is designed to run at slow speed (e.g. one tenth of the speed of the blending conveying means) in a casing containing particulate material to a depth completely covering each turn of the elongate member at least at the inlet end of the metering conveying means. The amount of material dispensed from each metering conveying means into the blending means can be adjusted by varying the speed of rotation and/or the pitch of the elongate member forming the conveying means.

A blending device according to the invention may be used not only to blend the particulate materials, but also to blend a dosed minor proportion of liquid inert to the other components of the blend. By 'inert' is meant both chemically and physically inert including at least to the extent that it is not a solvent for any solid component of the blend. It will be appreciated that the blending conveying means not only blends the components fed to it at its upstream end but conveys the mixture of particulate materials to the downstream end of the conveying means from whence it is discharged as a well blended mixture.

The provision of a cross-section of at least part arcuate form for the elongate member of the conveying means is important to the blending process. When a flat surface of the elongate member is presented in the conveying direct ion (e.g. a member of rectangular cross-section is used), it has been found that the material is liable to pack between the helical turns and the relative movement of the particles during their conveyance along the helical member, necessary for making a thorough blend, is inhibited.

Where each of the plurality of metering means also comprises a conveying helix in a casing, the elongate members forming these helices may be of any convenient cross-sectional shape (e.g. of flat, rectangular or round section). The helical conveying means may be driven at correlated speeds to deliver appropriate proportions of particulate materials, or the pitches of the helices may be varied and all conveying means may be driven at similar speeds of rotation to achieve the same purpose.

Where a component is required to form only a small proportion of a final blend, it can be desirable to meter such a component using a smaller diameter helix for the conveying means (and a smaller diameter casing) compared with that used to deliver a or the major component(s) of the blend, rather than rely solely on employing different speeds of rotation or different pitches of similarly sized helices.

Two streams of blended particulate materials may be obtained from a blending device in which the helix of the conveying means changes hand mid-way along its length. Such a helical conveying means having only one drive but receiving metered materials onto each different handed length adjacent to the centre of the length delivers two blends, one from each end of the helical conveying means.

BRIEF DESCRIPTION OF THE DRAWINGS

The invention will be further described by way of example, with reference to the accompanying drawings, in which.

DESCRIPTION OF PREFERRED EMBODIMENTS

Figure 1:
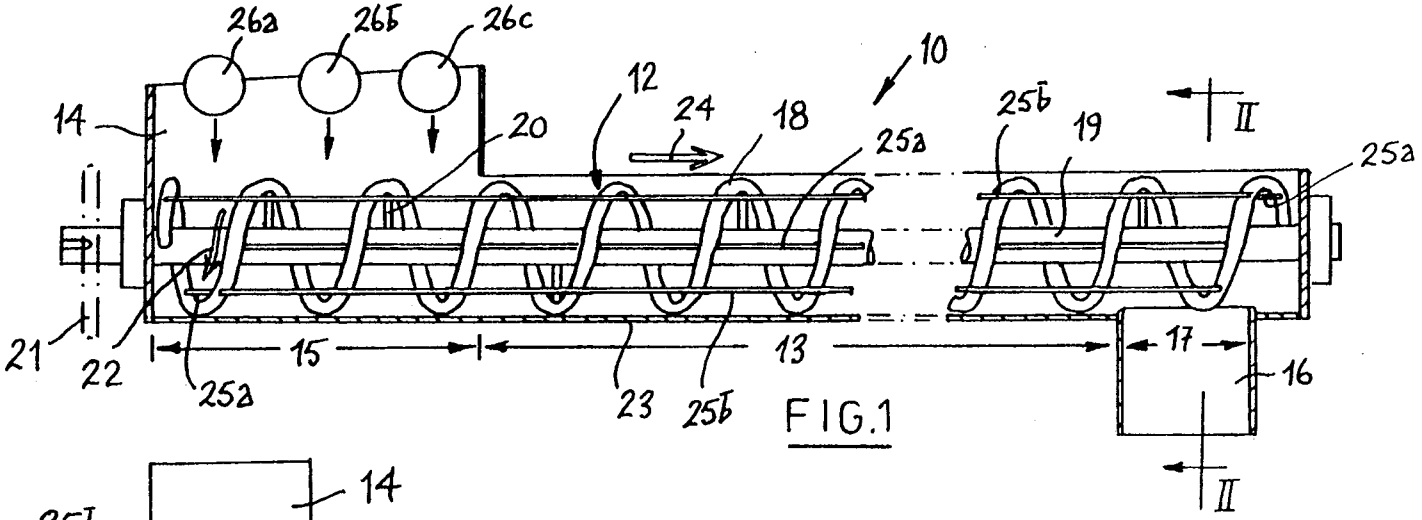
FIG. 1 is a sectional side elevation of a first embodiment of blending device made in accordance with the invention.

The blending device 10 shown in FIG. 1 basically comprises an inefficient helical conveying means 12 moving particulate materials (with a great deal of "fall back" and "tumbling" in a blending section 13) from an input hopper 14 (via an input sect ion 15) to a discharge chute 16 (via an output section 17). The section 13 of the conveying means 12 should be several times as long as the section 15 (typically between five and ten times as long).

Figure 2:
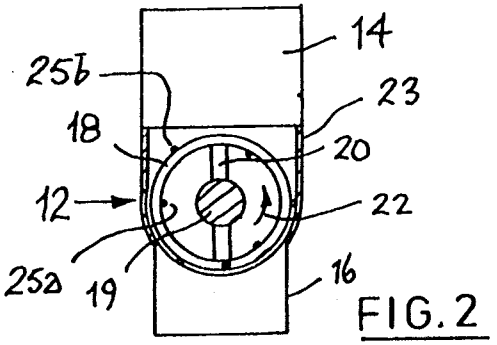
FIG. 2 is a transverse sectional view of the blending device of FIG. 1 taken on the line II—II of FIG. 1.

The conveying means 12 comprises an elongate member 18 of circular cross-section wrapped helically at constant pitch about a central drive shaft 19 and slightly inclined upwardly toward a discharge opening (which upward inclination is shown in FIG. 2). At intervals along its length, the member 18 is braced to the shaft 19 by radial arms 20. A drive wheel 21 is mounted on one end of the shaft 19 so that, in use of the blending device, the shaft 19 rotates (typically at a speed in the range 100 to 150 rpm) in the direction shown by the arrow 22.

The conveying means 12 is embraced throughout its length by a casing 23 which matches the cross-section of the lower half of i.e. conforms to the envelope shape of the conveying means 12 and supports the particulate materials being blended in a region where they are continually disturbed by the rotating turns of the member 18. In practice the depth of the layer of particulate material over the blending section 13 will be between one and two times the diameter of the cross-section of the member 18 (i.e. the lower part only of each turn of the helix is covered by the particulate material being blended).

To increase the agitation and tumbling of the particulate material in the casing 23 as it is conveyed in the direction of the arrow 24, stirring members are arranged between adjacent turns of the helix so that these are periodically moved through the shallow bed of material being conveyed towards the chute 16. As shown in FIG. 1 t he stirring means can be rods (or wires) **25*a*, 25*b* extending parallel to the axis of the shaft 19 at least over the blending sect ion 13 and conveniently over all three sections 13, 15 and 17. One rod 25*a* can be located between turns inside each turn and the next rod 25*b* can be located between turns outside each turn. The rods 25*a*, 25*b* can be attached (e.g. welded) to each turn or to just some of the turns as may be required to give a stable structure. FIG. 2 shows a section on the line II—II of FIG. 1 and indicate the open-topped nature of the casing 23**.

FIG. 1 shows three metering means **26*a*, 26*b* and 26*c* for feeding three different components of a mixture which is to be blended in the illustrated device 10. Any suitable means for supplying an accurately controlled rate of flow of material can be used but it is preferable to use in each metering means a similar conveying means to that shown at 12 in FIG. 1**, i.e. they rotate in a casing whose lower portion conforms to the envelope shape of the metering conveying means.

Figure 4:
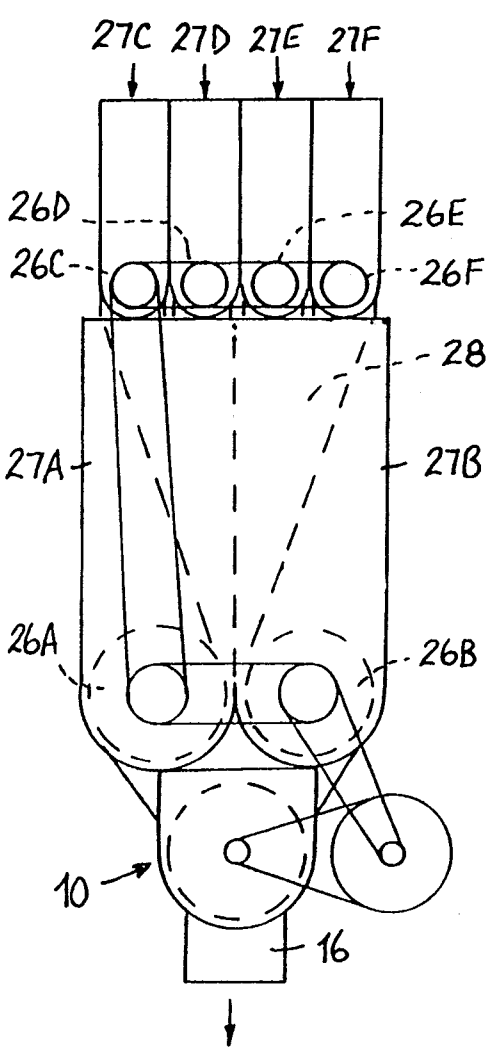
FIG. 4 is an end view of the arrangement shown in FIG. 3.
Figure 3:
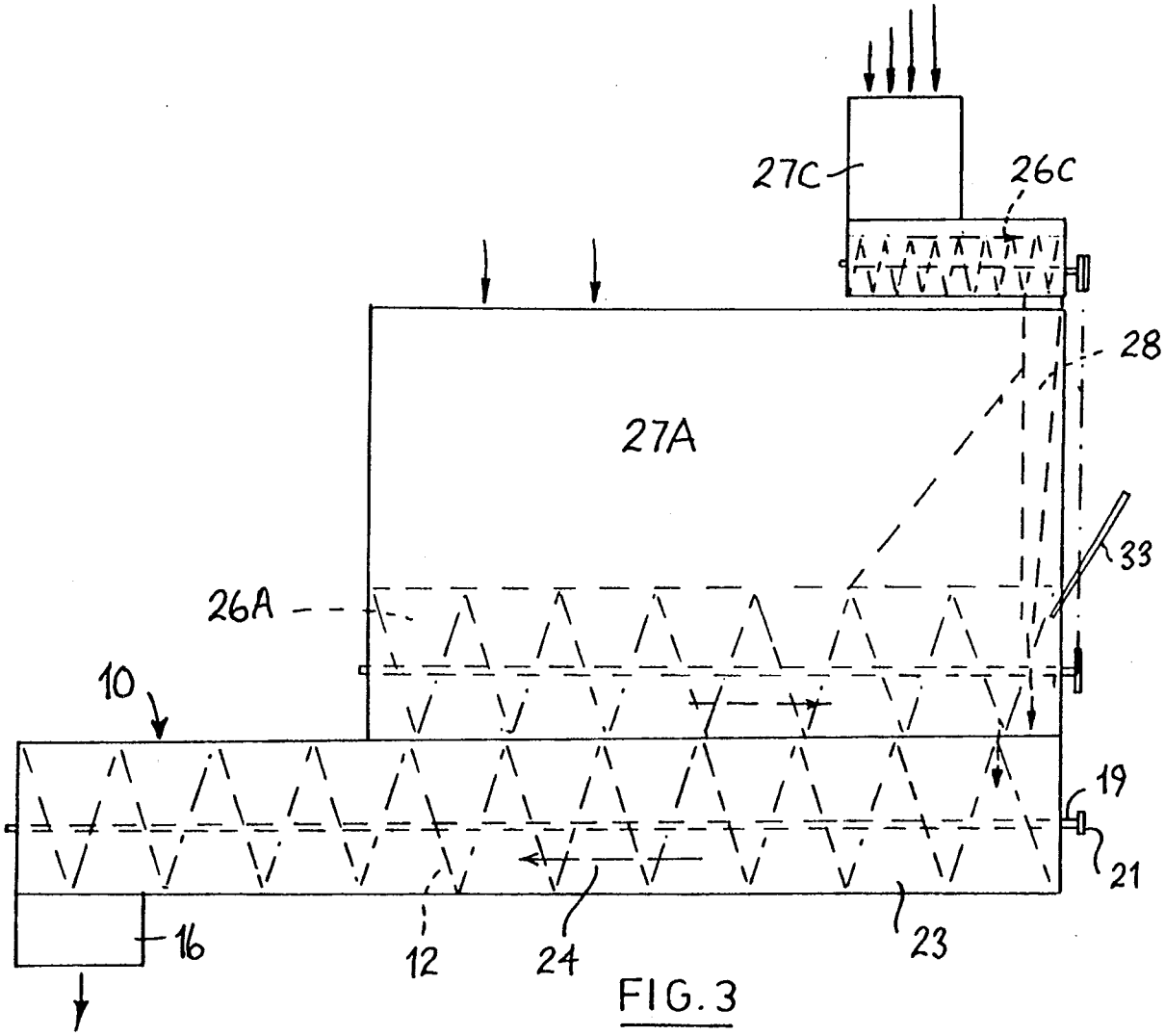
FIG. 3 is a schematic side elevation of an arrangement embodying six metering devices and the blending device of FIG. 1.

FIGS. 3 and 4 show such an arrangement in which two main metering conveyors 26A, 26B are combined with four secondary metering conveyors 26C–26F. Hoppers 27A to 27F are provided above each conveyor and contain enough material to cover the turns of the respective conveying means at all times during use of the arrangement. Each conveyor 26A to 26F discharges its output into the hopper 14 of the blending device 10, the conveyors 26C–26F discharging into a downwardly converging duct 28 which opens into the hopper 14. Since the secondary metering conveyors 26C–26F are intended to feed minor proportions of the ingredients of the mixture blended in the device 10, they can be of shorter length and smaller diameter than the conveyors 26A and 26B intended to meter major components of the blend.

Figure 5:
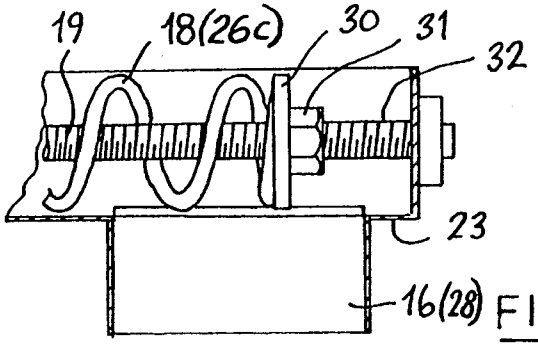
FIG. 5 is a scrap view showing how an adjustable pitch of a conveying helix can be arranged.

Each metering conveyor 26A–26F and the blending conveying means can be driven from a single prime mover (e.g. an electric motor). To provide different rotational speeds for the different conveyors, gearboxes of variable ratio can be used as can chain and sprocket drives or toothed wheel and toothed belt drives. However, in practice it has been found that varying the pitch of the helical turns of any given metering conveyor is a very useful way of fine tuning the metering rate at which it delivers its component to the blending device and accordingly each metering conveyor can be constructed as shown in the scrap sect ion of FIG. 5. With this arrangement one end of the helically disposed rod (18) can be moved axially with respect to the shaft (19) by an end plate 30 and a nut 31 screw-threaded onto a tapped end 32 of the shaft. If the arrangement shown in FIG. 5 is used, any radial supports (e.g. the arms 20) of the helically disposed member and any stirring members (**25*a*, 25*b*) provided must be arranged to accommodate the slight axial movement made by each turn of the helix when the plate 30 is axially adjusted. Thus a rod forming a stirring member could be fixedly secured at one end to a turn of the helix and slidably mounted at all other turns. The blending conveying means could include a construction such as shown in FIG. 5 but it is not necessary to provide such a pitch adjustment facility in the blending device. A sliding device can be used in place of the threaded arrangement 30–32** to provide for helix pitch adjustment.

The arrangement shown in FIGS. 3 and 4 can also be used to add small volumes of liquid (e.g. a liquid surfactant) to a mixture of ingredients to be blended and an inlet region for such a liquid is indicated at 33 in FIG. 3. A 1% v/v addition of liquid surfactant has been found to provide "particle coating" of the blended mixture.

The blending device 10 may be specifically arranged to ensure back mixing of the particulate materials e.g. it may be inclined upwardly towards the discharge end thereof and/or fitted with contra-wound helix sections.

A mixture of xanthan gum powder and sodium carboxy methyl cellulose particles fed to the hopper 14 of the device 10 in the proportion of 10:1 was found to be blended by the device to an accuracy of ±1% over six random samples of the blend.

In a typical example of an apparatus according to FIGS. 3 and 4—the metering conveyors 26C–26F were each variable pitch helices of 51 mm (2 inches) diameter of 3.2 mm ($\frac{1}{8}$ inch) diameter round sect ion rod of 9.5 mm ($\frac{3}{8}$ inch) pitch and the conveyors 26A, 26B were of variable pitch helices of 200 mm (8 inches ) diameter of 9.5 mm ($\frac{3}{8}$ inch) diameter round section rod at 63.5 mm ($2\frac{1}{2}$ inch) pitch. The elongate member 18 in the blending device 10 was of the same size, pitch and rod diameter as the conveyors 26A, 26B but was of fixed pitch. The overall length of the blending device was some 2000 mm.

Figure 6:
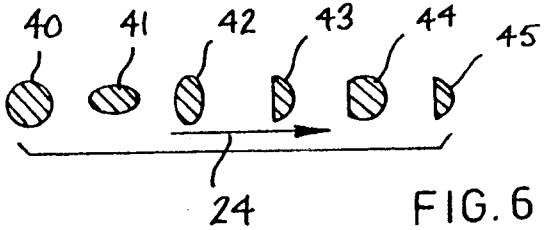
FIG. 6 shows some suitable cross-sections for the elongate member forming a conveying means of a blending device.

FIG. 6 shows some suitable cross-sectional shapes for the member 18 of the blending device. The section 40 is circular, the sections 41 and 42 elliptical, and the sections 43 to 45 part arcuate with a flat section facing away from the conveying direction 24.

I claim:

1. In a device for continuously blending particulate materials including a central shaft having an axis, a plurality of metering means, each to meter a respective quantity of a respective particulate material; blending means to receive and blend the metered quantities of particulate material delivered from the respective metering means, said blending means comprising conveying means in the form of an elongate member having a rotating axis coinciding with said axis of said shaft, said elongate member being disposed helically in turns about and concentric to the rotating axis, means to rotate the elongate member about its rotating axis to trace out an envelope shape of the casing in which the conveying means is located, said casing having a discharge end and a lower portion conforming to said envelope shape of the helically formed elongate member, the conveying means rotating in the casing so as to generate a conveying direction for particulate material in the casing towards the discharge end thereof, and stirring members provided on the conveying means and extending between at least some adjacent turns of the helically formed member, the elongate member having a cross-section which is of arcuate form at least on a side thereof facing said conveying direction to create an inefficient conveying means, and the stirring members being arranged on an outside portion of at least some adjacent turns of the elongate member, the stirring members extending a full length of the helically formed member so that the adjacent stirring members are positioned alternatingly inside and outside the helical turns, each metering means including a respective metering conveying means formed from a metering elongate member having turns helically disposed about an axis of rotation, means to rotate the metering elongate member about the axis of rotation, a metering casing to contain the metering elongate member, the metering casing having a lower portion, the turns of the helically formed metering elongate member rotating so as to trace out an envelope shape, said lower portion of the metering casing conforming to the envelope shape of the helically formed metering elongate member, at least some of the metering conveying means in the metering means are equipped with means to vary a pitch of a helix of the respective elongate member; a single prime mover, the conveying means in the metering means and the blending means being driven from said single prime mover at correlated speeds of rotation.

2. A device as claimed in claim 1, wherein the stirring members are wires.

3. A device as claimed in claim 1, wherein the elongate member has a circular cross-section and a pitch which is constant throughout its length.

4. A device as claimed in claim 1, wherein at least some of the stirring members are disposed parallel to the rotating axis.

* * * * *